US006380905B1

(12) United States Patent
Annamaa et al.

(10) Patent No.: US 6,380,905 B1
(45) Date of Patent: Apr. 30, 2002

(54) PLANAR ANTENNA STRUCTURE

(75) Inventors: Petteri Annamaa; Jyrki Mikkola, both of Oulu (FI)

(73) Assignee: Filtronic LK Oy, Kempele (FI)

( * ) Notice: Subject to any disclaimer, the term of this patent is extended or adjusted under 35 U.S.C. 154(b) by 80 days.

(21) Appl. No.: 09/658,008

(22) Filed: Sep. 8, 2000

(30) Foreign Application Priority Data

Sep. 10, 1999 (FI) ..... 19991929

(51) Int. Cl.[7] ..... H01Q 1/36
(52) U.S. Cl. ..... 343/767; 343/700 MS
(58) Field of Search ..... 343/700 MS, 767, 343/702, 846, 815

(56) References Cited

U.S. PATENT DOCUMENTS 5,170,175 A * 12/1992 Kobus et al. ..... 343/895
5,448,252 A * 9/1995 Ali et al. ..... 343/700 MS
6,114,996 A * 9/2000 Nghiem ..... 343/700 MS

FOREIGN PATENT DOCUMENTS

EP 0 279 050 8/1988 ..... H01Q/9/04
WO WO 98/38694 9/1998 ..... H01Q/9/04
WO WO 98/56067 12/1998 ..... H01Q/1/38

* cited by examiner

*Primary Examiner*—Don Wong
*Assistant Examiner*—James Clinger
(74) *Attorney, Agent, or Firm*—Darby & Darby

(57) ABSTRACT

The invention relates to a planar antenna structure in small-sized radio apparatus. A layer of dielectric material, the dielectric constant of which is relatively high, is arranged outwards of the plane of the outer surface of the radiating element of a planar inverted F antenna, or PIFA. The layer is located so as to cover at least the areas in which the electric field is the strongest when the antenna resonates. In the case of dual-band antenna, the slot in the radiating element is made advantageously so wide that the effect of the coupling between the branches (A1, A2) of the element is small. An antenna according to the invention can be made smaller in size and at least as good in its electrical characteristics as a corresponding prior-art antenna. Alternatively, the electrical characteristics of the antenna can be substantially improved without making the size of the antenna bigger.

6 Claims, 3 Drawing Sheets

PLANAR ANTENNA STRUCTURE

The invention relates to an internal planar antenna structure in small-sized radio apparatus such as mobile phones.

In portable radio apparatus it is very desirable that the antenna be placed inside the covers of the apparatus, for a protruding antenna is impractical. In modem mobile stations, for example, the internal antenna naturally has to be small in size. This requirement is further emphasized as mobile stations become smaller and smaller. Furthermore, in dual-band antennas the upper operating band at least should be relatively wide, especially if the apparatus in question is meant to function in more than one system utilizing the 1.7–2 GHz band.

When aiming at realizing a small-sized antenna the most common solution is to use a PIFA (planar inverted F antenna) structure. The radiating element in a PIFA may form a continuous plane, producing an antenna of one useful operating band. The radiating element may also have a slot in it which divides the element, viewed from the feed point, into two branches so that an antenna of two useful operating bands can be produced. The latter structure is more interesting since mobile stations functioning in two systems utilizing different frequency bands have become popular. The dual-band structure also provides for a suitable framework for the description of the present invention.

Figure 1:
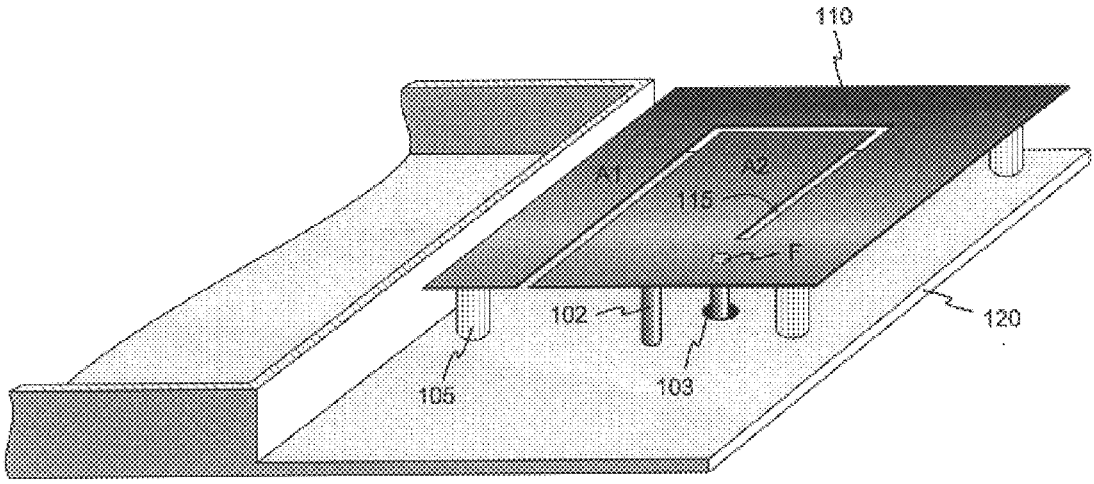
Fig. 1 PRIOR ART

FIG. 1 shows an example of a prior-art dual-band PIFA. In the Figure there can be seen the frame 120 of the apparatus in question which is drawn horizontal and which functions as the ground plane of the antenna. Above the ground plane there is a planar radiating element 110 which is supported by insulating pieces, such as 105. Between the radiating element and ground plane there is a short-circuit piece 102. The radiating element 110 is fed at a point F through a hole 103 in the ground plane. In the radiating element there is a slot 115 which starts from the edge of the element and extends to near the feed point F after having made two rectangular bends. The slot divides the radiating element, viewed from the feed point F, into two branches A1 and A2 which have different lengths. The longer branch A1 comprises in this example the main part of the edge regions of the radiating element, and its resonance frequency falls on the lower operating band of the antenna. The shorter branch A2 comprises the middle region of the radiating element, and its resonance frequency falls on the upper operating band of the antenna.

In the structure according to FIG. 1 the slot between the branches of the radiating element is relatively narrow so that there exists an electromagnetic coupling of considerable magnitude between the branches. As a consequence, the electrical length of the branches is greater than the mechanical length. This, in turn, results in the advantage that an antenna functioning in given frequency bands becomes smaller compared to a corresponding antenna without said electromagnetic coupling. A disadvantage of the coupling is, however, that the electrical characteristics of the antenna are affected; for example, the bandwidth becomes smaller and the losses become greater. Conversely, if the slot in the radiating element is made wider, the electrical characteristics of the antenna will improve, but the antenna has to be made bigger. As is known, the frequency bands may also be made wider by increasing the distance between the radiating element and ground plane, but this arrangement, too, has the disadvantage of making the antenna bigger.

The object of the invention is to reduce said disadvantages associated with the prior art. The structure according to the invention is characterized by what is expressed in the independent claim 1. Some preferred embodiments of the invention are presented in the other claims.

The basic idea of the invention is as follows: a layer of dielectric material, the dielectric constant of which is relatively high, is arranged outwards of the plane of the outer surface of the radiating element of a PIFA. The layer is located so as to cover at least the areas in which the electric field is the strongest when the antenna resonates. In the case of a dual-band antenna the slot of the radiating element is made advantageously so wide that the effect of the coupling between the branches of the element is small.

The addition of dielectric material has the known effect of shifting down the resonance frequency or frequencies of the antenna so that in order to retain a given resonance frequency the size of the resonating element has to be reduced. On the other hand, the addition of dielectric material at advantageous locations has the effect of keeping the impedance of the antenna close to the nominal value over a wider frequency range, which means a greater bandwidth. This is based on directing the stray flux flowing outside the space between the radiating element and ground plane onto a wider route. As was described above, the widening of the slot of the radiating element results in the improvement of the electrical characteristics of the antenna but, on the other hand, it also results in the fact that the antenna has to be made bigger if the resonance frequencies are to be located as desired.

By suitably combining addition of dielectric material "on top" of the radiating element and widening of the slot in the element, the antenna can be made smaller and at least as good in its electrical characteristics as a corresponding prior-art antenna. Alternatively, the electrical characteristics of the antenna can be substantially improved without increasing the size of the antenna. In the latter case, the effects on the size of the antenna of the addition of dielectric material and widening of the slot of the radiating element are opposite to each other. Naturally, in accordance with the invention, a structure may be arranged which falls in or outside the intermediate area between said two cases. In addition, the invention has the advantage that the structure according to it is simple and relatively low in manufacturing costs.

Figure 3:
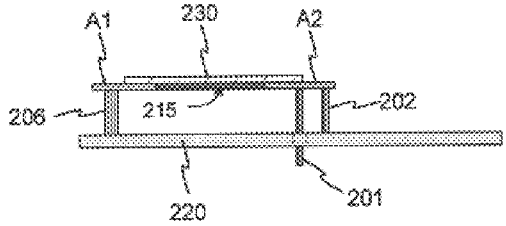
Figure 4:
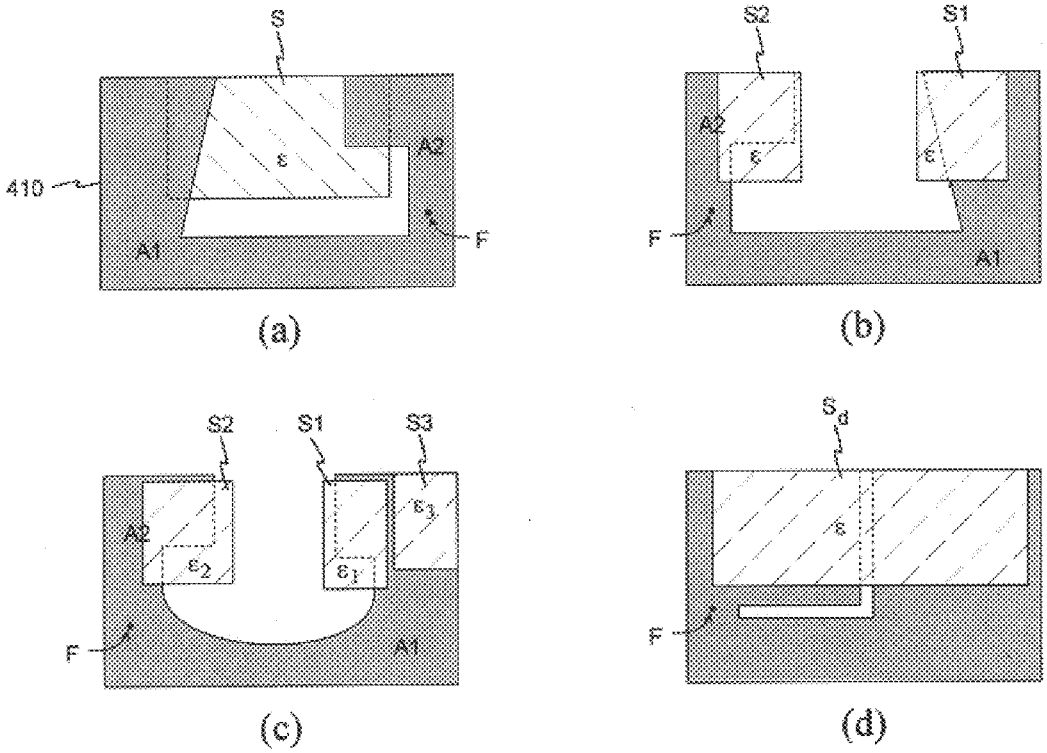
Figure 4:
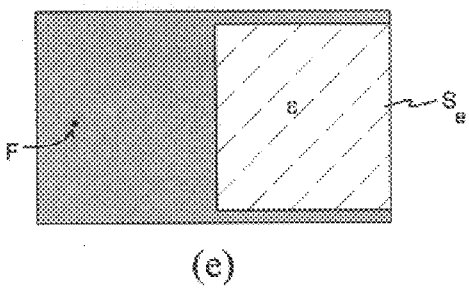
Figure 5:
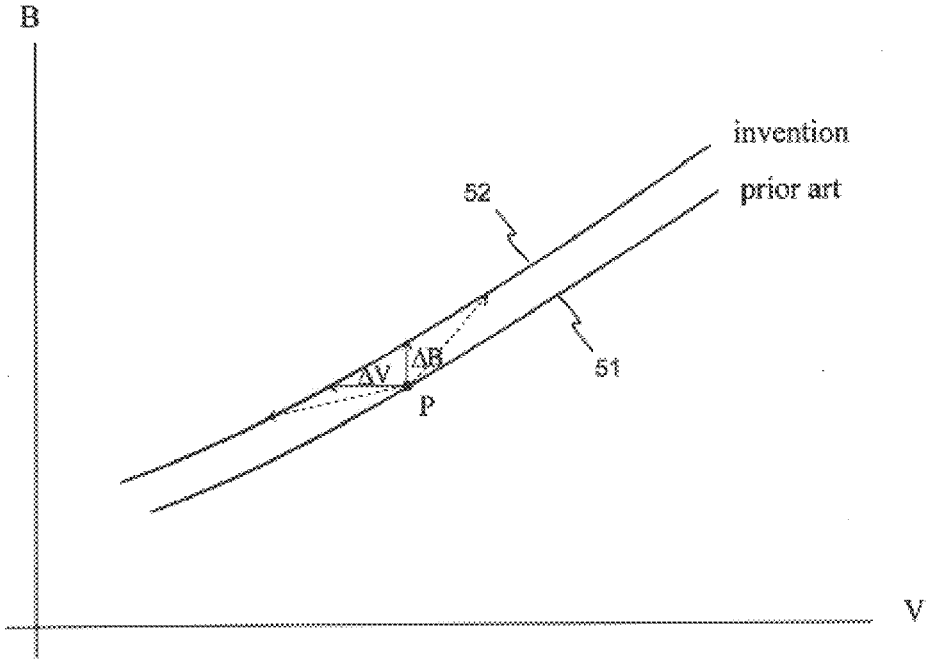
Figure 6:
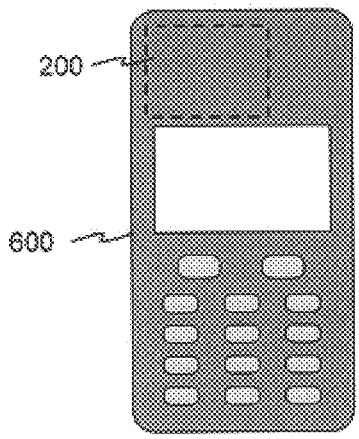

The invention will now be described in detail. In the description, reference will be made to the accompanying drawings in which FIG. 1 shows an example of a PIFA according to the prior art, FIG. 2 shows an example of a PIFA according to the invention, FIG. 3 shows a side view of a structure according to FIG. 2, FIG. 4 shows some embodiments of the invention, FIG. 5 shows by means of curves the advantage achieved by the invention, and FIG. 6 shows an example of a mobile station equipped with an antenna according to the invention.

FIG. 1 was already discussed in connection with the description of the prior art.

Figure 2:
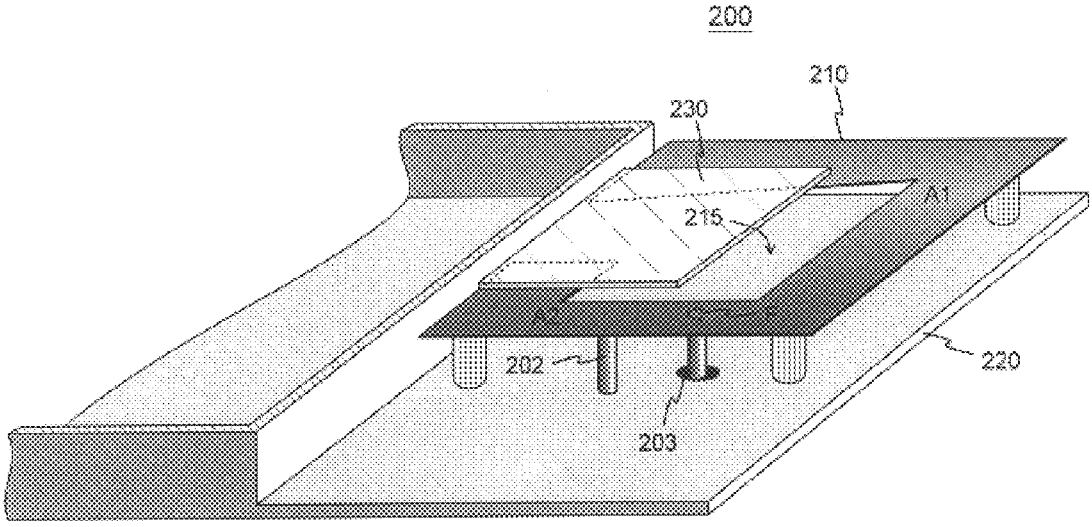

FIG. 2 shows an example of the antenna structure according to the invention. The basic solution in the antenna 200 is identical with that of FIG. 1. It comprises a radiating element 210, ground plane 220, and a short-circuit piece 202 therebetween. The inner conductor of the antenna feed line is connected through a hole 203 in the ground plane to the radiating plane 210 at a point F, which in the example depicted is near the front edge of the radiating element. In the radiating element 210 there is a slot 215 which starts from the left-hand edge of the element as drawn and extends to near the feed point F. As in FIG. 1, the slot of the radiating element divides the element, viewed from the feed point F, into two branches A1 and A2. Branch A1 is longer than branch A2. The difference from FIG. 1 is that in accordance with the invention the slot is considerably large. It separates the branches A1 and A2 to such an extent that the electromagnetic coupling between them is substantially weaker than in the structure of FIG. 1.

The most important difference from known structures is the dielectric plate 230 on the outer surface of the radiating element 210. "Outer surface" of the radiating element refers here and in the claims to the surface opposite to that surface of the radiating element which faces the ground plane. In the example of FIG. 2 the dielectric plate 230 is solid and covers portions of the farther ends of branches A1 and A2 as viewed from the feed point F. In these areas the effect of the dielectric material on the stray flux of the antenna is at its greatest because when a branch of the element is in resonance, the electric field is the strongest at the far end of the branch, whereby the stray flux, too, is at its greatest there. In the example of FIG. 2, the dielectric plate 230 additionally covers a great portion of the area 215 between the branches A1 and A2.

Let such a dielectric layer be here called a superstrate. The "superstrate" may be composed of a ceramic or plastic, for example. The greater the permittivity of the superstrate, the greater the stray flux-directing effect thereof. Of course, the relative permittivity $\in_r$ has to be greater than one; advantageously more than ten. However, when the value of the coefficient $\in_r$ is increased, the losses caused by the superstrate become adversely high at a certain point. The optimum value of the coefficient $\in_r$ depends on the case; it may be 40–50, for example.

FIG. 3 shows the structure according to FIG. 2 viewed from the side and from the higher portion of the frame of the apparatus. The ground plane 220 is shown. Of the radiating element, the ends of the branches A1 and A2 are visible as is the space 215 between them, which is shown darker. On top of the radiating element there is a superstrate 230 such that it covers the branches A1 and A2 partly and the mouth portion between them entirely. In addition, FIG. 3 shows the feed conductor 201, short-circuit piece 202 and one support piece 206 of the radiating element.

FIG. 4 depicts a few embodiments of the invention. The top left subfigure (a) shows the arrangement of FIG. 2 viewed from the ground plane side. There is on the outer surface of the radiating element 410 a superstrate S, like the layer 230 in FIGS. 2 and 3. The superstrate S has a certain permittivity $\in$. Subfigure (b) shows an arrangement which is otherwise identical with that of subfigure (a) but the superstrate now comprises two parts. Superstrate S1 covers the end of branch A1 of the radiating element, and superstrate S2 covers the end of branch A2. In subfigure (c) there is shown two superstrates S1 and S2 like in subfigure (b) but with the difference that they have different permittivities $\in$. The permittivity of the former is $\in_1$ and that of the latter is $\in_2$. In addition, branch A1 is firther covered by a third separate superstrate S3 which has a certain permittivity $\in_3$. Subfigure (d) shows a conventional radiating element with a narrow slot and thereupon, in accordance with the invention, a relatively large superstrate $S_d$. The arrangement according to subfigure (d) facilitates antennas of particularly small size. Subfigure (e) shows a conventional single-band radiator on top of which, at the opposite end of the element with respect to the feed point F, there is in accordance with the invention a superstratum $S_e$. While such an antenna will not achieve a bandwidth advantage, it will achieve a size advantage.

The curves in FIG. 5 represent in principle a bandwidth B of the antenna as a function of the volume V of the antenna. Curve 51 represents the prior art and curve 52 represents the invention. They both are ascending curves, but the curve representing the invention is above the one representing the prior art. Indicated in the Figure is a point P corresponding to an antenna according to the prior art. When applying the invention to this antenna, it is possible to move in different directions from the point P. When moving to curve 52 in the vertical direction, the difference indicates the increase $\Delta B$ in bandwidth. When moving to curve 52 in the horizontal direction, the difference indicates the decrease $\Delta V$ in volume. Curves corresponding to those shown in FIG. 5 could also be drawn for the efficiency of the antenna, for example. In that case, too, the curve representing the antenna according to the invention would be above the curve representing the antenna according to the prior art.

FIG. 6 shows a mobile station 600. It has an antenna 200 according to the invention which in the example depicted is located entirely within the covers of the mobile station.

Above it was described an antenna structure according to the invention and some of its variants. The invention is not limited to them as far as the design of the radiating element and the location of the superstrate are concerned. Furthermore, the invention does not limit other structural solutions of the planar antenna nor its manufacturing method. The inventional idea can be applied in many ways within the scope defined by the independent claim 1.

What is claimed is:

1. An antenna structure comprising a planar radiating and ground plane connected to each other with a shorting conductor but are otherwise air insulated from each other, said radiating element having a slot extending to its edge, said slot dividing the radiating element, viewed from its feed point, into two branches to provide two separate operating frequency bands, said antenna structure further comprising dielectric material located, as viewed from the direction of a normal of the planar radiating element, substantially inside contours of the planar radiating element and covering at least partly the electrically farthest areas of the outer surfaces of said branches as viewed from said feed point, to increase the bandwidth of the antenna structure.

2. A structure according to claim 1, wherein an area of said slot is greater than a tenth of an area of said radiating element.

3. A structure according to claim 1, wherein said dielectric layer comprises at least two separate parts (S1, S2).

4. A structure according to claim 3, wherein at least two parts that belong to said dielectric layer have different permittivities ($\in_1$, $\in_2$).

5. A structure according to claim 1, wherein the dielectric constant of said dielectric material is greater than ten.

6. A radio apparatus comprising an antenna having a radiating plane and a ground plane connected to each other with a shorting conductor but are otherwise air insulated from each other, said radiating element having a slot extending to its edge, said slot dividing said radiating element, viewed from its feed point, into two branches to provide two separate operating frequency bands, said antenna structure further comprising dielectric material located, as viewed from the direction of a normal of the planar radiating element, substantially inside contours of the planar radiating element, and covering at least partly the electrically farthest areas of outer surfaces of said branches as viewed from said feed point, to increase the bandwidth of said antenna structure.

* * * * *